US007264597B2

(12) United States Patent
Cathignol

(10) Patent No.: US 7,264,597 B2
(45) Date of Patent: Sep. 4, 2007

(54) DEVICE AND METHOD FOR PRODUCING HIGH-PRESSURE ULTRASONIC PULSES

(75) Inventor: Dominique Cathignol, Genas (FR)

(73) Assignee: Institut National de la Sante et de LacRecherchedMedicale, Paris Cedex (FR)

( * ) Notice: Subject to any disclaimer, the term of this patent is extended or adjusted under 35 U.S.C. 154(b) by 0 days.

(21) Appl. No.: 10/491,480

(22) PCT Filed: Oct. 4, 2002

(86) PCT No.: PCT/FR02/03390

§ 371 (c)(1),
(2), (4) Date: Jul. 21, 2004

(87) PCT Pub. No.: WO03/028904

PCT Pub. Date: Apr. 10, 2003

(65) Prior Publication Data

US 2004/0254506 A1 Dec. 16, 2004

(30) Foreign Application Priority Data

Oct. 4, 2001 (FR) ..... 01 12774

(51) Int. Cl.
*A61H 5/00* (2006.01)

(52) U.S. Cl. ..... 601/4; 600/459; 600/437; 367/157

(58) Field of Classification Search ..... 601/2–4; 600/459, 437, 439; 367/151, 153, 157, 155
See application file for complete search history.

(56) References Cited

U.S. PATENT DOCUMENTS

| | | | | |
|---|---|---|---|---|
| 5,549,110 | A * | 8/1996 | Krauss et al. | 600/447 |
| 5,582,578 | A * | 12/1996 | Zhong et al. | 601/4 |
| 5,800,365 | A * | 9/1998 | Zhong et al. | 601/4 |
| 6,231,529 | B1 | 5/2001 | Bauer et al. | |
| 2001/0001603 | A1 * | 5/2001 | Fink et al. | 367/138 |

FOREIGN PATENT DOCUMENTS

DE 197 33 233 C 9/1998

OTHER PUBLICATIONS

Patent Abstracts of Japan, vol. 013, No. 472, Oct. 25, 1989.

* cited by examiner

*Primary Examiner*—Brian L. Casler
*Assistant Examiner*—John F. Ramirez
(74) *Attorney, Agent, or Firm*—Cohen Pontani Lieberman & Pavane LLP

(57) ABSTRACT

A device for producing high pressure ultrasound pulses. The device includes an ultrasound source having a piezoelectric transducer provided with electrodes and presenting polarization in a given direction ($f_1$). An electrical voltage is applied to the electrodes to emit an ultrasound wave and to apply an electric field in a direction ($f_2$) opposite to the polarization direction ($f_1$) in order to compress the ultrasound transducer. A transient electric field having the same direction ($f_3$) as the polarization direction ($f_1$) is then applied so as to cause a compression ultrasound wave to be emitted in the coupling medium.

8 Claims, 1 Drawing Sheet

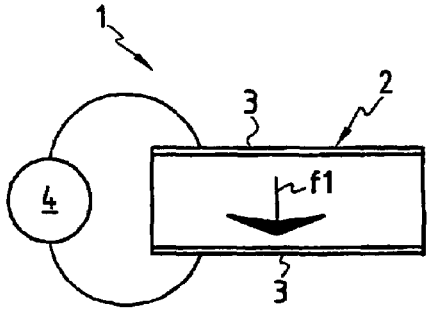
FIG.1
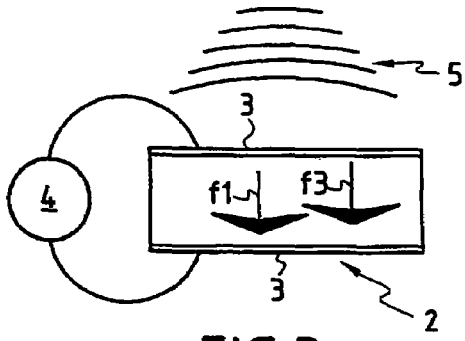
FIG.3
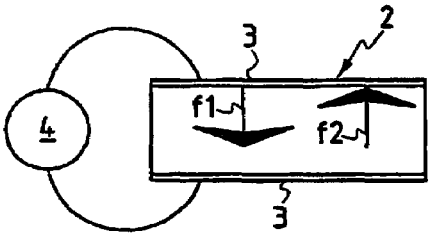
FIG.2
FIG.4
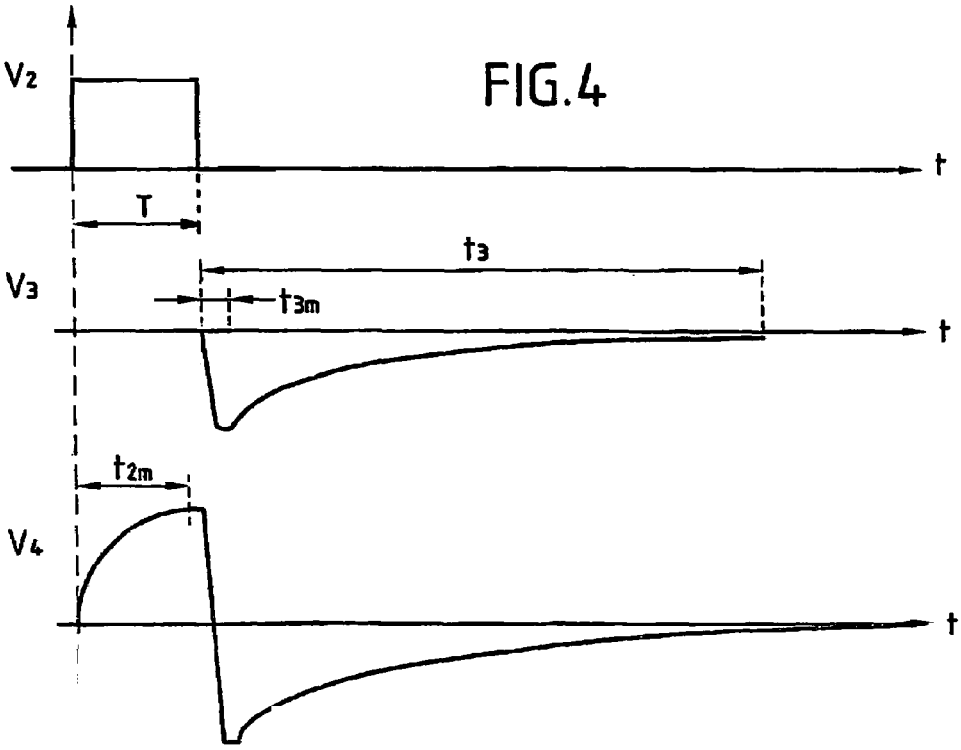

DEVICE AND METHOD FOR PRODUCING HIGH-PRESSURE ULTRASONIC PULSES

PRIORITY CLAIM

This is a U.S. national stage of application No. PCT/FR02/03390, filed on Oct. 4, 2002. Priority is claimed on that application and on the following application: Country: France, Application No.: 01/12774, filed: Oct. 4, 2001.

BACKGROUND OF THE INVENTION

Field of the Invention

The present invention relates to the technical field of generating ultrasound pulses of very high intensity, i.e. of the order of several hundreds of bars, or even about a thousand bars.

The present invention relates to applications in particular in the field of non-destructive inspection of a material or a structure, or in the medical field (lithotrity, destroying tissue by cavitation, . . . ).

Ultrasound pulses are produced in a coupling medium by means of a source comprising a piezoelectric type transducer which, when an electrical voltage is applied thereto, produces a soundwave that is generally focused in order to achiever high pressures. In this respect, it should be observed that the ratio that exists between the pressure at the focus and the pressure at the surface of the transducer is known as "antenna gain". Such antenna gain is a function of the emitted frequency, and also of the aperture, i.e. the ratio of the focal length to the diameter of the transducer. By way of illustration, a wave having pressure of 1000 bars at the focus of a lithotriter can be generated using a source in the form of a cup having a diameter of approximately 45 centimeters (cm) with surface pressure of about 10 bars, and at a frequency of 400 kilohertz (kHz).

It should thus be observed that such a source for producing ultrasound pulses is large in size, which means that it is not possible to make devices that are portable or semi-portable. In order to be able to reduce the size of such a source, it is necessary to be able to increase the surface pressure at the emitting cup.

In an attempt to achieve this object, the prior art has proposed using composite type materials known as piezo-composites, that enable surface pressure to be increased by a factor of about 1.5 to 2, compared with conventional piezo-ceramic materials. With this type of material, which vibrates essentially in thickness, the lateral modes that are generated are of amplitude that is smaller than is the case for conventional piezo-ceramic materials. Although that improvement is advantageous, it is nevertheless still insufficient.

In the doctoral thesis presented by Luc Chofflet to the University of Paris VIII entitled "L'étude de l'optimisation des transducteurs ultrasonores et des structures multi-piézo-électriques empilées" [Studying the optimization of ultrasound transducers and stacked multi-piezoelectric structures], it is shown that it is possible to increase surface pressure by assembling two transducers in the form of a sandwich. From a theoretical point of view, the improvement is proportional to the number of layers in the stack. Nevertheless, practical investigation has shown that the real improvement is smaller, because the front transducer receives the stress in full, leading to the frontmost element breaking. Furthermore, although it is already complex to make such a stacked-type transducer when the transducer is plane in shape, it becomes extremely difficult to make a transducer implementing this principle in the form of a cup.

In the prior art, transducers of the Tonpilz (acoustic mushroom) type are also known that are designed mainly for generating a monochromatic wave, usable in particular for sonars for fishing or naval purposes. French patents FR 2 640 455 and FR 2 728 755 describe various ways of establishing mechanical stress on the piezoelectric material in order to generate high pressures.

It should be observed that clamping the piezoelectric material of the transducer lowers the resonant frequency of the assembly as a whole to a great extent. Thus, such a transducer operates with a resonant frequency of only a few tens of kilohertz at the most, such that application thereof is restricted to sonars.

Furthermore, insofar as the transducer is built up as a stack of layers, such a source can transmit only the frequency for which the set of layers enters into resonance, which means that it is not possible to transmit a pressure pulse that presents a broad frequency spectrum, and thus that it is not possible to transmit a pulse of short duration. In addition, a transducer implementing a stack of layers is not simple to make.

In the state of the art, there is also disclosed, by U.S. Pat. No. 5,549,110, a device for producing sound pulses comprising a piezo-ceramic type transducer provided with electrodes connected to means for applying an electrical voltage to said electrodes. In a variant embodiment, the means for applying an electrical voltage serve to apply an electric field opposite in direction to the direction in which the transducer is polarized, and subsequently, to apply a transient electric field in the same direction as that in which the transducer is polarized in order to cause a soundwave to be emitted.

Implementing electrical prestress on the piezoelectric transducer serves to avoid the problems inherent with applying mechanical prestress. In addition, insofar as the transducer is compressed prior to being subjected to extension in order to create a high pressure ultrasound wave, no lengthening occurs that might break it.

Nevertheless, the device for producing sound pulses as described in that patent cannot be used in practice in an application to lithotrity in particular. The shape of the wave produced by such a device does not satisfy the constraints associated with an acoustic shockwave. In particular, the prestress applied to the transducer leads to an expansion wave being generated of magnitude substantially equal to that of the subsequently generated compression wave. The expansion wave leads to cavitation which impedes good propagation of the following compression wave. In addition, the prestress applied to the transducer inevitably leads to it being depolarized.

OBJECTS AND SUMMARY OF THE INVENTION

The object of the invention is thus to remedy the drawbacks of the state of the art by proposing a device suitable for producing high pressure ultrasound pulses without creating a prior expansion wave, while being designed to avoid depolarizing the piezoelectric transducer, and which is nevertheless made in a manner that is simple.

To achieve this object, the device of the invention for producing high pressure ultrasound pulses comprises:

- an ultrasound source comprising a piezoelectric type transducer provided with electrodes and presenting polarization in a given direction; and means for applying an electrical voltage to the electrodes of the ultrasound transducer, serving, in order to emit an ultrasound wave:

to apply an electric field in the direction opposite to the polarization direction in order to compress the ultrasound transducer; and then to apply a transient electric field having the same direction as the polarization direction, so as to cause a compression ultrasound wave to be emitted in the coupling medium.

According to the invention, the means apply a progressive electrical voltage with a rise time for creating an electric field of direction opposite to the polarization direction for an application duration that is shorter than the duration leading to depolarization of the piezoelectric ultrasound transducer.

Another object of the invention is to propose a device for producing high pressure ultrasound pulses that is adapted to avoid depolarizing the transducer and that, in particular, presents high amplitude polarization suitable for causing it to be depolarized progressively.

To achieve such an object, the device in accordance with the invention for producing ultrasound pulses comprises means for applying an electrical voltage that cause a transient electric field to be applied during an application time that is greater than or equal to the duration of application of the electric field in the direction opposite to the polarization direction in order to enable the ultrasound transducer to be repolarized, if necessary.

Various other characteristics appear from the description given below with reference to the accompanying drawing which show, as non-limiting examples, embodiments and implementations of the subject matter of the invention.

BRIEF DESCRIPTION OF THE DRAWINGS

FIGS. 1 to 3 are various diagrammatic views of a device in accordance with the invention for producing ultrasound pulses, the device being shown in various characteristic operating positions.

FIG. 4 is a timing diagram for illustrating the principle on which the device of the invention operates.

DETAILED DESCRIPTION OF THE PRESENTLY PREFERRED EMBODIMENTS

As can be seen more clearly in FIG. 1, the device for producing high pressure ultrasound pulses given overall reference 1 comprises an ultrasound transducer 2 of piezoelectric type forming a source for producing a soundwave in a coupling medium. The transducer 2 has mutually parallel electrodes connected to means 4 for applying an electrical voltage.

The transducer 2 is not described in greater detail since its structure is well known to the person skilled in the art. In addition, as its active element for generating a soundwave, the ultrasound transducer 2 may comprise any piezoelectric type of material such as piezo-ceramic, piezo-composite, or piezoelectric polymer material.

In conventional manner, the transducer 2 presents polarization in a direction that is perpendicular to the electrodes 3 and as represented by arrow $f_1$. The transducer 2 thus operates in compression/expansion mode insofar as the polarization direction specific to the piezoelectric material is parallel to the electric field created by the electrodes 3 when an electrical voltage is applied to its terminals. The deformation of the piezoelectric material of the transducer takes place in a direction that is essentially parallel to the electric field.

In accordance with the invention, the means 4 serve to apply electrical prestress to the transducer 2 prior to producing a high pressure ultrasound wave. As shown in FIG. 2, the means 4 are controlled so as to apply a progressive electrical voltage to the electrodes 3 of the transducer 2 so as to create, in the piezoelectric material, an electric field in the direction opposite to the polarization direction $f_1$ and as represented by arrow $f_2$, thereby compressing the transducer 2 progressively. Thus, as can be seen clearly from FIG. 2 in comparison with FIG. 1, the progressive electrical voltage applied to the electrodes 3 is such that the transducer 2 is subjected to an electric field of direction $f_2$ that is opposite to its polarization, such that the transducer 2 is progressively compressed. The transducer 2 is compressed progressively since the pressure generated is proportional to the rate of variation of the voltage (its derivative). As can be seen in FIG. 4, the control voltage $V_2$ of duration T leads to a progressive electrical voltage with a rise time $t_{2m}$ being applied to the electrodes 3 of the transducer, as can be seen in the portion of the figure that corresponds to the voltage $V_4$.

Thereafter, the means 4 cause an electrical voltage $V_3$ to be applied serving to create a transient electric field in the piezoelectric material in the same direction as the polarization direction. Thus, as can be seen more clearly in FIG. 3, the transducer 2 is subjected to an electric field as represented by arrow $f_3$ that is in the same direction $f_1$ as the polarization. Starting from the preceding state, the transducer 2 is subjected to expansion so as to emit a compression wave 5 into the coupling medium.

As can be seen from the above description, the subject matter of the invention is a simple method for causing an ultrasound wave 5 to be emitted by progressively compressing the transducer 2 by applying thereto an electric field of direction opposite to the polarization direction of the transducer by means of a progressively-varying electrical voltage, followed by an electric field in the same direction as the polarization, thereby leading to expansion. Insofar as the transducer 2 was initially compressed prior to being lengthened, it can be considered that the transducer 2 departs little from its initial state as shown in FIG. 1. The transducer 2 is subjected to lengthening that is sufficiently small to avoid breaking it. Furthermore, the fact that the transducer 2 is prestressed progressively avoids the appearance of an expansion wave that might impede the propagation of the compression wave.

According to a characteristic of the invention, the means 4 apply an electrical voltage that enables an electric field of direction $f_2$ opposite to the polarization direction $f_1$ to be applied for an application duration T that is shorter than the duration that would lead to the piezoelectric transducer 2 being depolarized (FIG. 4). For example, the application duration T of said progressive electrical voltage for applying an electric field of direction opposite to the polarization direction is greater than 10 microseconds (μs), and is preferably about 100 μs. Thus, the application of a progressive voltage during a limited time enables the transducer 2 to be prestressed progressively without being depolarized.

According to a preferred implementation characteristic, the means 4 serve to apply an electrical voltage $V_3$ to create the transient electric field in the same direction $f_3$ as the direction $f_1$ of polarization for an application time $t_3$ lying in the range 1 μs to 1 second (s), and preferably of about 100 milliseconds (ms).

According to a preferred implementation characteristic, the application time $t_3$ of the transient electric field is greater than or equal to the application duration T of the electric field of direction $f_2$ opposite to the polarization direction $f_1$ so as to enable the piezoelectric ultrasound transducer 2 to repolarize in the event of any small depolarization occurring, in particular in the special case of the transducer 2 being polarized with large amplitude. As can be seen in FIG. 4, the electrical voltage $V_3$ generating the compression wave returns progressively to its initial value (0 volts) so as to enable the transducer to be repolarized.

According to another preferred implementation characteristic, the means 4 for applying an electrical voltage $V_3$ apply a transient electric field having the same direction $f_3$ as the polarization direction $f_1$ during a rise time $t_{3m}$ lying in the range 0.1 μs to 20 μs, and preferably lying in the range 1 μs to 10 μs for the purposes of lithotrity.

The third timing diagram in FIG. 4 shows the waveform of the electrical voltage $V_4$ across the terminals of the transducer 2. According to a preferred implementation characteristic, the progressive electrical voltage for applying an electric field of direction $f_2$ opposite to the polarization direction $f_1$ presents a rise time $t_{2m}$ that is greater than the rise time $t_{3m}$ of the transient electric field, so as to minimize the influence of an interfering wave, specifically an expansion wave. In a preferred embodiment, this rise time $t_{2m}$ is at least ten times greater than the rise time $t_{3m}$ of the transient electric field.

The invention thus makes it possible to provide a device for producing a high pressure ultrasound wave. Thus, a maximum pressure of 35 bars (before deterioration) has been obtained with a transducer that does not implement the invention. With a transducer to which electrical prestress has been applied, it has been possible to obtain a maximum pressure of 60 bars.

Naturally, the means 4 for applying electrical voltages to the terminals of the electrodes can be made in any suitable manner by one or two generators, for example. In addition, the transducer may be given any shape, for example it can be made in the form of a cup.

The invention is not limited to the examples described and shown since various modifications can be applied thereto without going beyond the ambit of the invention.

What is claimed is:

1. A device for producing high pressure ultrasound pulses in a coupling medium, the device comprising:

an ultrasound source comprising a piezoelectric type transducer provided with electrodes and presenting polarization in a given direction ($f_1$); and means for applying an electrical voltage to the electrodes of the piezoelectric type transducer, serving, in order to emit an ultrasound wave:

to apply a progressive electric field in the direction ($f_2$) opposite to the polarization direction ($f_1$) in order to compress the piezoelectric type transducer; and then to apply a transient electric field having a rise time ($t_{3m}$) in the same direction ($f_3$) as the polarization direction ($f_1$), so as to cause a compression ultrasound wave to be emitted in the coupling medium;

wherein the progressive electrical voltage has a rise time ($t_{2m}$) for creating an electric field of direction ($f_2$) which has a duration (T) that is shorter than the duration necessary to depolarize the piezoelectric type transducer, the rise time ($t_{2m}$) being at least ten times greater than the rise time ($t_{3m}$) of the transient electric field.

2. A device for producing high pressure ultrasound pulses according to claim 1, characterized in that the duration (T) of application of a progressive electrical voltage for applying an electric field of direction ($f_2$) opposite to the polarization direction ($f_1$) is greater than 10 μs.

3. A device for producing high pressure ultrasound pulses according to claim 1, characterized in that the means for applying a progressive electrical voltage apply a transient electrical field having the same direction ($f_3$) as the polarization direction ($f_1$) for an application time ($t_3$) lying in the range of from about 1 μs to about 1 s.

4. A device for producing high pressure ultrasound pulses according to claim 1, characterized in that the means for applying an electrical voltage apply a transient electric field in the same direction ($f_3$) as the polarization direction ($f_1$) during a rise time ($t_{3m}$) lying in the range of from about 0.1 μs to about 20 μs.

5. A device for producing high pressure ultrasound pulses according to claim 1, characterized in that the electrical voltage for applying a progressive electric field of direction ($f_2$) opposite to the polarization direction ($f_1$) has a rise time ($t_{2m}$) greater than the rise time ($t_{3m}$) of the transient electric field.

6. A device for producing high pressure ultrasound pulses according to claim 1, characterized in that the application time ($t_3$) of the transient electric field is greater than or equal to the application duration (T) of the electric field of direction ($f_2$) opposite to the polarization direction ($f_1$), to enable the ultrasound transducer to repolarize, if necessary.

7. A device for producing high pressure ultrasound pulses according to claim 2, characterized in that the duration (T) of application of a progressive electrical voltage for applying an electric field of direction ($f_2$) opposite to the polarization direction ($f_1$) is about 100 μs.

8. A device for producing high pressure ultrasound pulses according to claim 3, characterized in that the means for applying a progressive electrical voltage apply a transient electrical field having the same direction ($f_3$) as the polarization direction ($f_1$) for an application time ($t_3$) of approximately 100 μs.

* * * * *